US007234450B1

(12) United States Patent
Takakura et al.

(10) Patent No.: US 7,234,450 B1
(45) Date of Patent: Jun. 26, 2007

(54) GAS DENSITY RATIO DETECTOR, GAS CONCENTRATION DETECTOR, AND FUEL VAPOR TREATMENT APPARATUS

(75) Inventors: Shinsuke Takakura, Kariya (JP); Masao Kano, Gamagori (JP); Noriyasu Amano, Gamagori (JP); Shinsuke Kiyomiya, Seto (JP); Yuusaku Nishimura, Toyota (JP)

(73) Assignees: Denso Corporation (JP); Toyota Jidosha Kabushiki Kaisha (JP)

( * ) Notice: Subject to any disclaimer, the term of this patent is extended or adjusted under 35 U.S.C. 154(b) by 0 days.

(21) Appl. No.: 11/397,891

(22) Filed: Apr. 5, 2006

(30) Foreign Application Priority Data

Apr. 5, 2005 (JP) ..... 2005-108881

(51) Int. Cl.
*F02M 51/00* (2006.01)

(52) U.S. Cl. ..... 123/494; 123/520; 73/861.52; 73/119 A

(58) Field of Classification Search ..... 123/520, 123/519, 518, 516, 494; 73/119 A, 861.52, 73/861.83, 861.81, 861.02, 861.04, 861.29, 73/861.65

See application file for complete search history.

(56) References Cited

U.S. PATENT DOCUMENTS 4,041,757 A * 8/1977 Baker et al. ..... 73/202.5
4,074,573 A * 2/1978 Nordhofen ..... 73/861.52
4,562,744 A * 1/1986 Hall et al. ..... 73/861.02
4,748,959 A * 6/1988 Cook et al. ..... 123/406.45
4,836,032 A * 6/1989 Redus et al. ..... 73/861.04
5,363,832 A * 11/1994 Suzumura et al. ..... 123/704
5,596,972 A * 1/1997 Sultan et al. ..... 123/520
5,621,657 A * 4/1997 Ferri ..... 702/47
5,676,118 A * 10/1997 Saito ..... 123/679
6,453,887 B1 * 9/2002 Hayashi et al. ..... 123/520
6,651,514 B2 * 11/2003 Zanker ..... 73/861.52
6,729,319 B2 * 5/2004 Mitsutani ..... 123/687
6,971,375 B2 12/2005 Amano et al.

FOREIGN PATENT DOCUMENTS

JP 6-101534 4/1994

* cited by examiner

*Primary Examiner*—Carl S. Miller
(74) *Attorney, Agent, or Firm*—Nixon & Vanderhye PC

(57) ABSTRACT

When a gas flow producer is driven, plural kinds of gases flow into a measure-passage at respective timing. An orifice is provided in the measure-passage. The orifice has a diameter-changing portion which restricts a separation of gases from an inner surface of the measure-passage. A pressure sensor is provided in the measure-passage to detect a pressure determined by the orifice and the gas flow producer. A microcomputer calculates a density ratio between the gases based on the detected differential pressure.

5 Claims, 10 Drawing Sheets

GAS DENSITY RATIO DETECTOR, GAS CONCENTRATION DETECTOR, AND FUEL VAPOR TREATMENT APPARATUS

CROSS REFERENCE TO RELATED APPLICATIONS

This application is based on Japanese Patent Applications No. 2005-108881 filed on Apr. 5, 2005, the disclosure of which is incorporated herein by reference.

FIELD OF THE INVENTION

The present invention relates to a gas density ratio detecting apparatus, a gas concentration detecting apparatus, and a fuel vapor treatment apparatus.

BACKGROUND OF THE INVENTION

In a fuel vapor treatment apparatus, fuel vapor evaporated in a fuel tank is temporarily adsorbed by a canister. Negative pressure in an intake passage of an engine is introduced into the canister so that the fuel vapor is desorbed and purged into the intake passage. JP-6-101534A shows a fuel vapor treatment apparatus in which a fuel vapor concentration of an air-fuel mixture is detected to control a purge amount of fuel vapor. Density of the air fuel mixture is detected in a purge passage which is for introducing the air-fuel mixture into the intake passage, and density of air is detected in an atmosphere passage opened to atmosphere. The fuel vapor concentration is calculated based on a ratio between the density of the air-fuel mixture and the density of the air. An orifice is respectively provided in the purge passage and the atmosphere passage. The densities of the air-fuel mixture and the air are calculated based on a differential pressure between both ends of the orifice. Thus, the density ratio is affected by the tolerance of each orifice. Besides, the density of the air-fuel mixture is detected while the air-fuel mixture is purged into the intake passage. Thus, the density of air-fuel mixture cannot be detected in a situation that the purge is not performed after the engine is started, so that the fuel vapor is hardly purged by a large amount in a short period.

The inventors have studied the technology in which pressure in a measure-passage with an orifice is reduced by air pump to introduce the air and the air-fuel mixture in a different timing so that the differential pressure between both ends of the orifice or the amount of air passing through the orifice is measured. The density ratio between the air and the air-fuel mixture is calculated based on the above measured result. According to this technology, the density ration can be detected by operating the air pump before purging, and only one orifice is used to detect the density ratio so that the tolerance of the orifice hardly affect on the measured result. However, according to the inventors' study, in a case that an orifice 1000 of which inner diameter is constant along the center axis thereof as shown in FIG. 17, following problems will arise.

Generally, density ρ of gas flowing through an orifice and a differential pressure ΔP between both ends of orifice have a relationship expressed by the following equation (1) by use of an air flowrate Q at the orifice, a cross-section area A, and a flowrate coefficient α.

$$\rho=2\cdot(\alpha\cdot A/Q)^2\cdot\Delta P \quad (1)$$

In a case that the air flowrate Q corresponds to the suction amount of the air pump, the air flowrate Q can be derived from a characteristic of pressure (P)-flowrate (Q) of the air pump. In order to calculate the ratio between air density $\rho_{Air}$ and the air-fuel mixture density $\rho_{Gas}$, it is necessary to obtain an air differential pressure $\Delta P_{Air}$, an air-fuel mixture differential pressure $\Delta P_{Gas}$, and an air flowrate coefficient $\alpha_{Air}$, and an air-fuel mixture flowrate coefficient $\alpha_{Gas}$. When the coefficient $\alpha_{Air}$ and the coefficient $\alpha_{Gas}$ are equal to each other, the ratio between the density $\rho_{Air}$ and the density $\rho_{Gas}$ can be precisely calculated based on the measured differential pressures $\Delta P_{Air}$ and $\Delta P_{Gas}$. However, in the case that the orifice 1000 having a constant inner diameter is used, the inventors have found out that the coefficient $\alpha_{Air}$ and the coefficient $\alpha_{Gas}$ are different from each other. Since the coefficient $\alpha_{Air}$ and the coefficient $\alpha_{Gas}$ are physical value depending on the density $\rho_{Air}$ and the density $\rho_{Gas}$, the coefficients $\rho_{Air}$ and $\alpha_{Gas}$ cannot be measure beforehand in calculating the density ratio. Thus, it must be assumed that the coefficient $\alpha_{Air}$ and the coefficient $\alpha_{Gas}$ are equal to each other in order to calculate the ratio between the density $\rho_{Air}$ and the density $\rho_{Gas}$, so that the accuracy of calculating the ratio between $\rho_{Air}$ and $\rho_{Gas}$ may be deteriorated.

In a case that the air pump is controlled in such a manner that the differential pressure $\Delta P_{Air}$ and the differential pressure $\Delta P_{Gas}$ become equal to each other, it is necessary to obtain the flowrate $Q_{Air}$ of air, and the flowrate $Q_{Gas}$ of the air-fuel mixture, and the coefficients $\alpha_{Air}$, $\alpha_{Gas}$ at the orifice. If the coefficient $\alpha_{Air}$ and the coefficient $\alpha_{Gas}$ were equal to each other, the ratio between the density $\rho_{Air}$ and the density $\rho_{Gas}$ could be precisely calculated. However, as described above, the coefficient $\rho_{Air}$ and the coefficient $\alpha_{Gas}$ are different from each other in a case that the orifice 1000 is used.

SUMMARY OF THE INVENTION

The present invention is made in view of the above matters, and it is an object of the present invention to provide a gas density ratio detecting apparatus which precisely detects a density ratio between plural kinds of gases, and an orifice which is used in the gas density ratio detector.

It is the other object of the present invention to provide a gas concentration detecting apparatus and a fuel vapor treatment apparatus which are provided with a gas density ratio detecting apparatus detecting a density ratio between plural kinds of gases.

According to the present invention, plural kinds of gases are introduced into a measure-passage which is provided with an orifice therein. The orifice has a separation-restricting means which restricts a separation of gases from an inner surface of the measure-passage downstream of the orifice. By means of the separation-restricting means, the flowrate coefficient α in the above equation (1) does not depend on the kind of gases and the density, so that the ratio of the flowrate coefficient α between plural kinds of gases substantially becomes 1. Thus, the density ratio of the gases can be precisely detected based on the air flowrate at the orifice or the differential pressure between both ends of the orifice, which is measured with respect to plural kinds of gases in a condition where the measure-passage is decompressed.

The orifice is a restrictor of which length is shorter than a cross sectional length thereof as defined in Japanese Industrial Standard (JIS-B).

BRIEF DESCRIPTION OF THE DRAWINGS

The above and other objects, features, and advantages of the present invention will become more apparent from the following detailed description made with reference to the accompanying drawings, in which like parts are designated by like reference number and in which.

DETAILED DESCRIPTION OF THE PREFERRED EMBODIMENTS

Embodiments of the present invention will be described hereinafter with reference to the drawings.

First Embodiment

Figure 2:
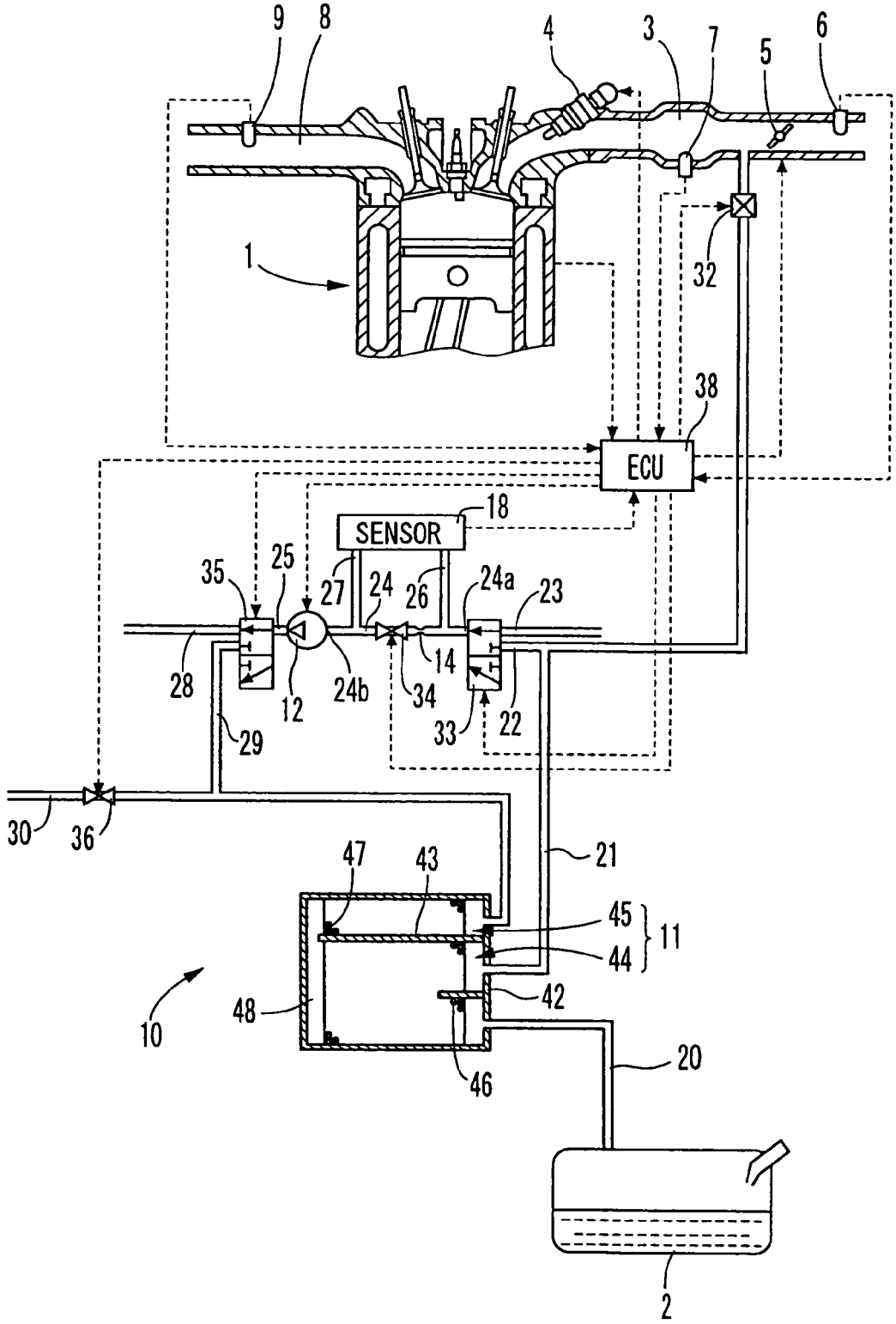
FIG. 2 is a construction diagram showing the fuel vapor treatment apparatus according to the first embodiment.

FIG. 2 shows an example to which a fuel vapor treatment apparatus 10 according to the first embodiment of the present invention is applied to the internal combustion engine 1.

The engine 1 is a gasoline engine that develops power by the use of gasoline fuel received in a fuel tank 2. The intake passage 3 of the engine 1 is provided with, for example, a fuel injection device 4 for controlling the quantity of fuel injection, a throttle valve 5 for controlling the quantity of intake air, an air flow sensor 6 for detecting the quantity of intake air, an intake pressure sensor 7 for detecting an intake pressure, and the like. Moreover, the discharge passage 8 of the engine 1 is provided with, for example, an air-fuel ratio sensor 9 for detecting an air ratio.

The fuel vapor treatment apparatus 10 processes fuel vapor generated in the fuel tank 2 and supplies it to the engine 1. The fuel vapor treatment apparatus 10 is provided with a canister 11, a pump 12, a differential pressure sensor 18, multiple passages 20 to 30, multiple valves 32 to 36, and an electronic control unit (ECU) 38.

The canister 11 has a case 42 partitioned by a partition wall 43 to form two adsorption parts 44, 45. The respective adsorption parts 44, 45 are packed with adsorptive agents 46, 47 made of activated carbon or the like.

The main adsorption part 44 is provided with an introduction passage 20 connecting with the inside of the fuel tank 2. Hence, fuel vapor generated in the fuel tank 2 flows into the main adsorption part 44 through the introduction passage 20 and is adsorbed by the adsorptive agent 46 in the main adsorption part 44 in such a way as to be desorbed. The main adsorption part 44 is further connected with the intake passage 3 through a purge passage 21. Here, a purge controlling valve 32 made of an electromagnetically driven type two-way valve is provided at the end of the intake passage side of the purge passage 21. The purge controlling valve 32 is opened or closed to control the connection of the purge passage 21 and the intake passage 3. With this, in a state where the purge controlling valve 32 is opened, a negative pressure developed on the downstream side of the throttle valve 5 of the intake passage 3 is applied to the main adsorption part 44 through the purge passage 21. Therefore, when the negative pressure is applied to the main adsorption part 44, fuel vapor is desorbed from the adsorptive agent 46 in the main adsorption part 44 and the desorbed fuel vapor is mixed with air and is introduced into the purge passage 21, whereby fuel vapor in the air-fuel mixture is purged to the intake passage 3. In this regard, the fuel vapor purged into the intake passage 3 through the purge passage 21 is combusted in the engine 1 along with fuel injected from the fuel injection device 4.

The main adsorption part 44 connects with a subordinate adsorption part 45 via a space 48 at the inside bottom of the case 42. The fuel vapor desorbed from one of the main adsorption part 44 and the subordinate adsorption part 45 remains in the space 48, and then is adsorbed by the other adsorption part.

A passage changing valve 33 made of an electromagnetically driven type three-way valve is connected to a branch passage 22 branched from the purge passage 21 between the main adsorption part 44 and the purge controlling valve 32. Furthermore, the passage changing valve 33 is connected to a first atmosphere passage 23 opened to the atmosphere, and to the measure-passage 24. The passage changing valve 33 is connected to one end 24*a* of the measure-passage 24. The passage changing valve 33 is constructed in such a manner as to change a passage connecting with the measure-passage 24 between the first atmosphere passage 23 and the branch passage 22 of the purge passage 21. Thus, when the first atmosphere passage 23 is connected to the measure-passage 24, the air can flow into the measure-passage 24 from the one end 24*a* thereof. When the branch passage 22 is connected to the measure-passage 24, air-fuel mixture including the fuel vapor in the purge passage 21 can flow into the measure-passage 24 from the one end 24*a*.

The pump 12 is constructed of an electrically driven type vane pump. A suction port of the pump 12 is connected to the other end 24*b* of the measure-passage 24, and a discharge port of the pump 12 is connected to a first discharge passage 25. When the pump 12 is operated, the measure-passage 24 is decompressed to cause a flow of gases from the purge passage 22 and the first atmosphere passage 23 into the measure-passage 24. The gases flow in the passage 24 from the one end 24*a* toward the other end 24*b* of the passage 24. The one end 24*a* of the passage 24 is referred to as an upstream end, and the other end 24*b* of the passage 24 is referred to as a downstream end hereinafter. The pump 12 discharges the gases into the first discharge passage 25.

Figure 1:
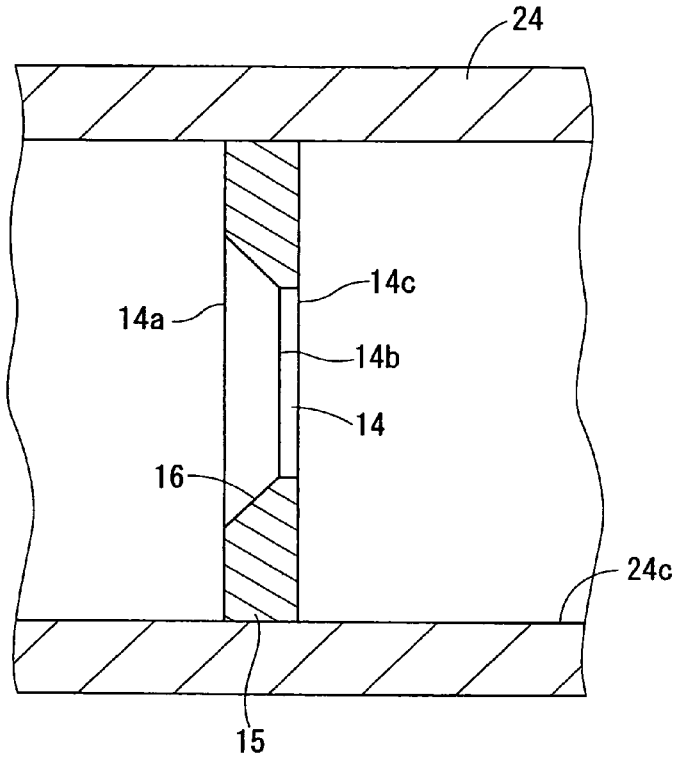
FIG. 1 is a cross sectional view showing an essential portion of a fuel vapor treatment apparatus according to a first embodiment.

An orifice 14 restricting a flow passage area of the measure-passage 24 is provided in the measure-passage 24 between the passage changing valve 33 and the pump 12. As shown in FIG. 1, the orifice 14 is formed by penetrating an orifice plate 15 in a thickness direction thereof. The thickness of the orifice plate 15 is significantly small relative to an inner diameter of the inner wall 24*c* of the measure-passage 24. The orifice 14 is substantially coaxial with the measure-passage 24. The axial length of the orifice 14 is shorter than the inner diameter of the orifice 14. The inner diameter of the orifice 14 is referred to as a cross sectional length of the orifice 14. The orifice 14 has a diameter-changing portion 16 of which inner diameter varies in the axial direction, which are formed between the downstream end 14*a* and a middle portion 14*b*. Specifically, the diameter-changing portion 16 has a shape of which inner diameter decreases from the downstream end 14*a* toward upstream side. The inner diameter decreases in a constant ratio, so that the diameter-changing portion 16 is tapered. An upstream portion relative to the diameter-changing portion 16, that is, a portion between the middle portion 14*b* and the upstream end 14*c* has a constant inner diameter.

As shown in FIG. 2, the differential pressure sensor 18 is connected to an upstream-pressure-introducing passage 26 and to a downstream-pressure-introducing passage 27. The upstream-pressure-introducing passage 26 branches from the measure-passage 24 between the passage changing valve 33 and the orifice 14. The downstream-pressure-introducing passage 27 branches from the measure-passage 24 between the pump 12 and the orifice 14. The differential pressure sensor 18 detects differential pressure between both ends of the orifice 14.

A passage opening/closing valve 34 made of an electromagnetically driven type two-way valve is provided in the measure-passage 24 between the branch point of the downstream-pressure-introducing passage 27 and the orifice 14. The passage opening/closing valve 34 opens/closes the measure-passage 24. When the passage opening/closing valve 34 closes the measure-passage 24, the differential pressure detected by the differential pressure sensor 18 is substantially equal to a shutoff pressure of the pump 12.

A discharge switching valve 35 made of an electromagnetically driven type three-way valve is provided in the first discharge passage 25 which is connected to the discharge port of the pump 12. The discharge switching valve 35 is connected to a second atmosphere passage 28 open to the atmosphere. Moreover, the discharge switching valve 35 is connected to a second discharge passage 29 connecting with the subordinate adsorption part 45 of the canister 11. The discharge switching valve 35 connected in such a manner as to select a passage connecting with the first discharge passage 25 between the second atmosphere passage 28 and the second discharge passage 29. Therefore, in the first state where the second atmosphere passage 28 connects with the first discharge passage 25, gas discharged from the pump 12 is dissipated to the atmosphere through the second atmosphere passage 28. Moreover, in the second state where the second discharge passage 29 connects with the first discharge passage 25, gas discharged from the pump 12 can flow into the subordinate adsorption part 45 through the second discharge passage 29.

A canister-close valve 36 made of an electromagnetically driven type two-way valve is provided in a third atmosphere passage 30 opened to atmosphere. The third atmosphere passage 30 is connected with the subordinate adsorption part 45 through the second discharge passage 29. When the canister-close valve 36 is closed, the subordinate adsorption part 45 is opened to atmosphere.

The ECU 38 is mainly constructed of a microcomputer having a CPU and a memory and is electrically connected to the pump 12, the differential pressure sensor 18, and the valves 32 to 36 of the fuel vapor treatment apparatus 10 and the respective elements 4 to 7 and 9 of the engine 1. The ECU 38 controls the respective operations of the pump 12 and the valves 32 to 36 on the basis of the detection results of the respective sensors 18, 6, 7, 9, the temperature of cooling water of the engine 1, the temperature of working oil of a vehicle, the number of revolutions of the engine 1, the accelerator position of the vehicle, the ON/OFF state of an ignition switch, and the like. Moreover, the ECU 38 of this embodiment has also the functions of controlling the engine 1, such as the quantity of fuel injection of the fuel injection device 4, the opening of the throttle valve 5, the ignition timing of the engine 1, and the like.

Figure 3:
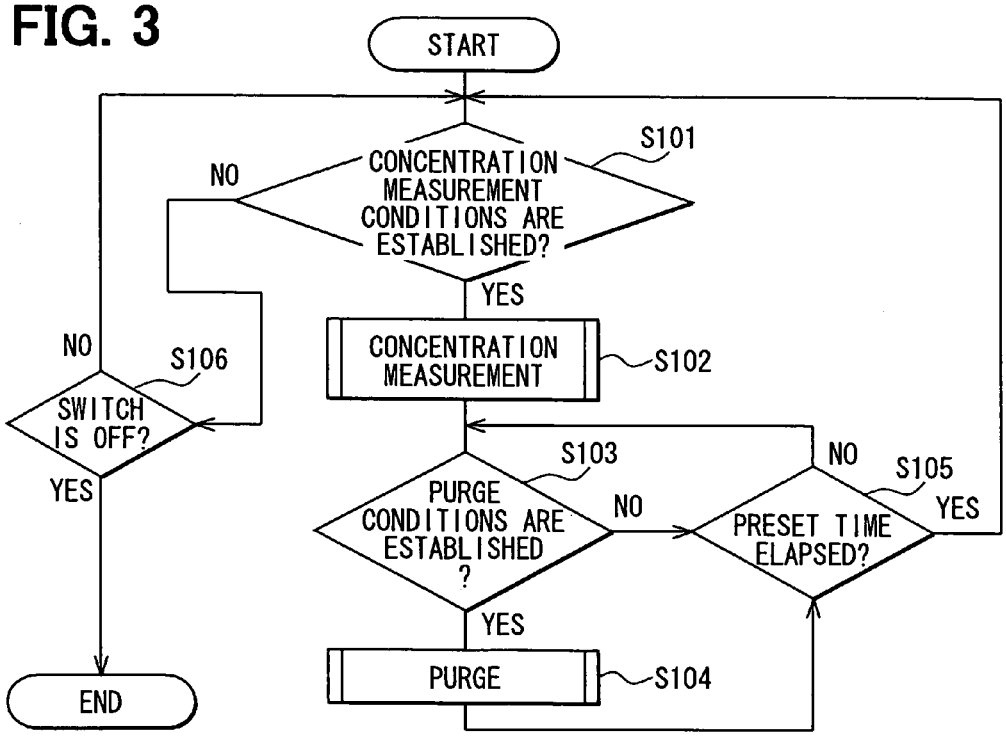
FIG. 3 is a flowchart for explaining a main operation of the fuel vapor treatment apparatus according to the first embodiment.

Referring to FIG. 3, the flow of a main operation characteristic of the fuel vapor treatment apparatus 10 will be described hereinafter. The main operation is started when an ignition switch is turned on to start the engine 1.

First, in step S101, ECU 38 determines whether or not concentration measurement conditions are established. Here, the satisfaction of the concentration measurement conditions means that the physical quantities expressing the state of a vehicle, for example, the temperature of cooling water of the engine 1, the temperature of working oil of a vehicle, the number of revolutions of the engine is within specific ranges. Such concentration measurement conditions are previously set such that they are satisfied just after the engine 1 is started and are stored in the memory of the ECU 38.

When it is determined that step S101 is affirmative, the routine proceeds to step S102 where concentration measurement processing is carried out. When the concentration of fuel vapor in the purge passage 21 is measured by this concentration measurement processing in a state where the purge controlling valve 32 is closed, the routine proceeds to step S103 where it is determined by the ECU 38 whether or not purge conditions are established. Here, the satisfaction of the purge conditions means that the physical quantities expressing the state of a vehicle, for example, the temperature of cooling water of the engine 1, the temperature of working oil of the vehicle, the number of revolutions of the engine are within specific ranges different from those of the above-mentioned concentration measurement conditions. Such purge conditions are previously set such that they are satisfied, for example, when the temperature of cooling water of the engine 1 becomes higher than a specific value and hence the warm-up of the engine 1 is completed and are stored in the memory of the ECU 38.

When it is determined that step S103 is affirmative, the routine proceeds to step S104 where purge processing is carried out. When fuel vapor is purged from the purge passage 21 into the intake passage 3 in a state where the purge controlling valve 32 is opened and purge stop conditions are satisfied, the routine proceeds to step S105. Here, the satisfaction of the purge stop conditions means that the physical quantities expressing the state of the vehicle, for example, the number of revolutions of the engine 1 and acceleration position are within specific ranges different from those of the above-mentioned concentration measurement conditions and the above-mentioned purge conditions. Such purge stop conditions are previously set such that they are satisfied, for example, when the acceleration position is made smaller than a specific value to decrease the speed of the vehicle, and are stored in the memory of the ECU 38.

Moreover, when it is determined that step S103 is negative, the routine proceeds directly to step S105.

In step S105, it is determined whether or not a set time elapses from the time when the concentration measurement processing in step S102 is finished. When it is determined that this step S105 is affirmative, the routine returns to step S101, whereas when it is determined that this step S105 is negative, the routine returns to step S103. Here, the above-mentioned set time to be the determination criterion in step S105 is previously set in consideration of secular changes in the concentration of fuel vapor and the required accuracy of the concentration and is stored in the memory of the ECU 38.

While following processing steps S102 to S105 when it is determined that step S101 is affirmative has been described, following processing step S106 when it is determined that step S101 is negative will be described.

In step S106, it is determined whether or not the ignition switch is turned off. When it is determined that this step S106 is negative, the routine returns to step S101. Meanwhile, when it is determined that this step S106 is affirmative, the main operation is finished.

The above-mentioned concentration measurement processing in step S102 will be described in more detail.

In a case that the density of Hydrocarbon is represented by $\rho_{HC}$ and the density of air in the first atmosphere passage 23 is represented by $\rho_{AIR}$, the fuel vapor concentration D of the air-fuel mixture in the purge passage 21 and the density $\rho_{GAS}$ of the air-fuel mixture have a relationship expressed by the following equation (2).

$$D=100\cdot\rho_{AIR}\cdot(1-\rho_{GAS}/\rho_{AIR})/(\rho_{AIR}-\rho_{HC}) \quad (2)$$

In order to calculate the concentration D based on the equation (2), the ratio between $\rho_{AIR}$ and $\rho_{GAS}$ is necessary. The way of calculating the ratio between $\rho_{AIR}$ and $\rho_{GAS}$ is described hereinafter.

Figure 4:
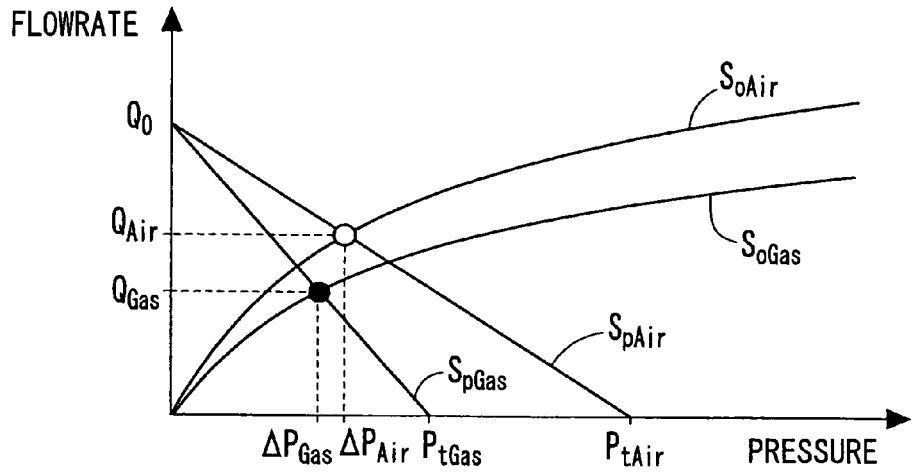
FIG. 4 is a graph for explaining a way of calculating a density ratio according to the first embodiment.

As shown in FIG. 4, in a case that the air and the air-fuel mixture flow through the orifice 14, the characteristic curves $S_{oAir}$ and $S_{oGas}$ with respect to differential pressure ($\Delta P$) and flowrate (Q) satisfy the equation (1). The ratio between $\rho_{AIR}$ and $\rho_{GAS}$ is expressed by the following equation (3) by use of the flowrate $Q_{Air}$, the differential pressure $\Delta P_{Air}$, and the flowrate coefficient $\alpha_{Air}$ in the case that the air flows through the orifice, and flowrate $Q_{Gas}$, the differential pressure $\Delta P_{Gas}$, and the flowrate coefficient $\alpha_{Gas}$ in the case the air-fuel mixture flows through the orifice.

$$\rho_{GAS}/\rho_{AIR}=\{(\alpha_{Gas}/\alpha_{Air})\cdot(Q_{Air}/Q_{Gas})\}^2\cdot\Delta P_{Gas}/\Delta P_{Air} \quad (3)$$

In this embodiment, the pressure loss becomes negligible small at downstream of the orifice 14 in the measure-passage 24. Thus, it can be assumed that the suction pressure P of the pump 12 and the differential pressure $\Delta P$ between both ends of the orifice 14 are equal to each other. It can be assumed that the suction amount Q of the pump 12 and air amount Q flowing through the orifice 14 are equal to each other. In the pump 12, such as vane pump, since the internal leak amount varies according to the load of the pump and the viscosity of the gas, the characteristic curves $S_{pAir}$ and $S_{pGas}$ with respect to the suction pressure P and the suction amount Q (refer to FIG. 4) are expressed by the following equations (4) and (5). In the equations (4) and (5), $Q_0$ represents a suction amount of the pump 12 which has no load. $P_{tAir}$ and $P_{tGas}$ respectively represent shutoff pressure of the pump 12 in a situation that the pump 12 intakes the air and the air-fuel mixture.

$$Q_{Air}=Q_0\cdot(1-\Delta P_{Air}/P_{tAir}) \quad (4)$$

$$Q_{Gas}=Q_0\cdot(1-\Delta P_{Gas}/P_{tGas}) \quad (5)$$

Thus, the equation (3) can be transformed into the following equation (6) by use of the equations (4) and (5).

$$\rho_{GAS}/\rho_{AIR}=\{(\alpha_{Gas}/\alpha_{Air})\cdot(1-\Delta P_{Air}/P_{tAir})/(1-\Delta P_{Gas}/P_{tGas})\}^2\cdot\Delta P_{Gas}/\Delta P_{Air} \quad (6)$$

Figure 17:
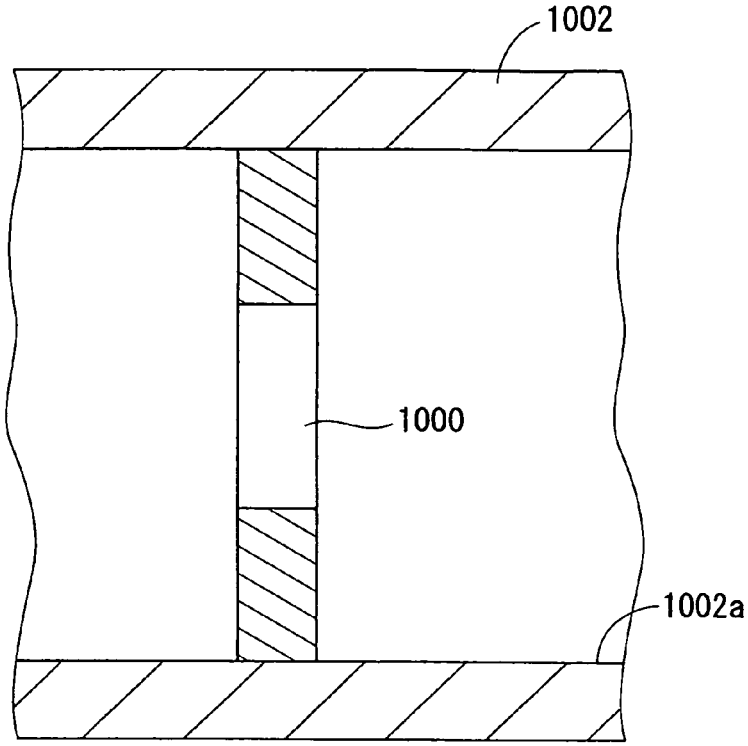
FIG. 17 is a cross sectional view showing a comparative example.

In the equation (6), the flowrate coefficients $\alpha_{Air}$ and $\alpha_{Gas}$ do not becomes equal to each other when the orifice has a constant inner diameter as shown in FIG. 17. On the other hand, in the present embodiment, since the orifice 14 has the diameter-changing portion 16, the coefficients $\alpha_{Air}$ and $\alpha_{Gas}$ become equal to each other. The principle in which $\alpha_{Air}$ and $\alpha_{Gas}$ become equal is described hereinafter.

Figure 5:
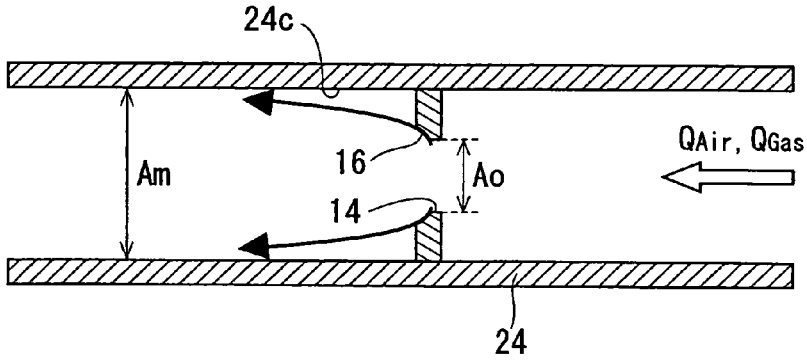
FIG. 5 is a cross sectional view of a measure-passage for explaining a gas flow according to the first embodiment.

The flowrate coefficient $\alpha$ in the measure-passage 24 can be expressed by the equation (7) by use of a speed coefficient $C_v$ and a contraction coefficient $C_c$ of the gas, and a restriction area ratio "m". As shown in FIG. 5, the passage area downstream of the orifice 14 in the measure-passage 24 is represented by $A_m$, and the cross sectional area of the upstream end 14*c* of the orifice 14 is represented by $A_0$. The restriction area ratio "m" is a relative ratio $A_0/A_m$.

$$\alpha=C_v\cdot C_c/(1-C_c^2\cdot m^2)^{1/2} \quad (7)$$

In the above equation (7), the speed coefficient $C_v$ corresponds to a loss coefficient which depends on a friction between the gas and the inner surface of the orifice. In this embodiment, since the axial length of the orifice 14 is shorter than the inner diameter, the speed coefficient $C_v$ can be assumed 1 substantially.

Figure 18:
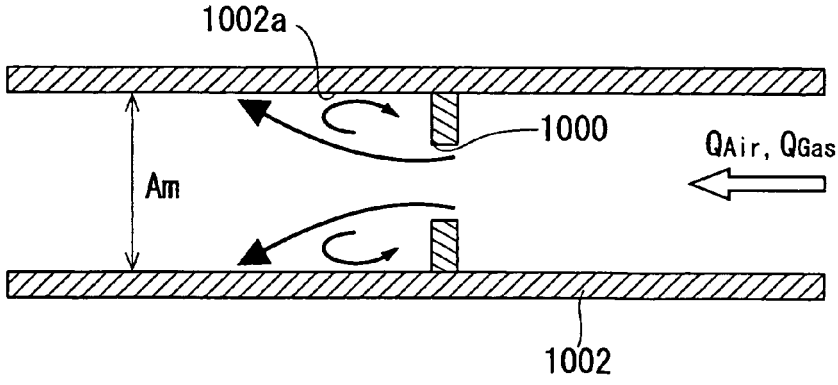
FIG. 18 is a cross sectional view of a measure-passage for explaining a gas flow according to the comparative example.

Besides, in the above equation (7), the contraction coefficient $C_c$ represents a degree of loss which is caused by the gas separation from the inner surface 24*c* of the measure-passage 24 downstream of the orifice 14. The contraction coefficient $C_c$ depends on the dynamic viscosity of the gas. In a comparative example shown in FIG. 18, the gas separates from an inner surface 1002*a* of the measure-passage 1002 downstream of the orifice 1000 having a constant inner diameter, and vortexes toward upstream arise. Thus, the contraction coefficient $C_c$ varies according to the dynamic viscosity of the gas. On the other hand, in the present embodiment, the separation of air is restricted by the diameter-changing portion 16 so that no vortexes of air arises. The contraction coefficient $C_c$ can be assumed the value which does not depend on the dynamic viscosity of the gas. That is, the coefficient $C_c$ can be assumed 1.

Figure 6A:
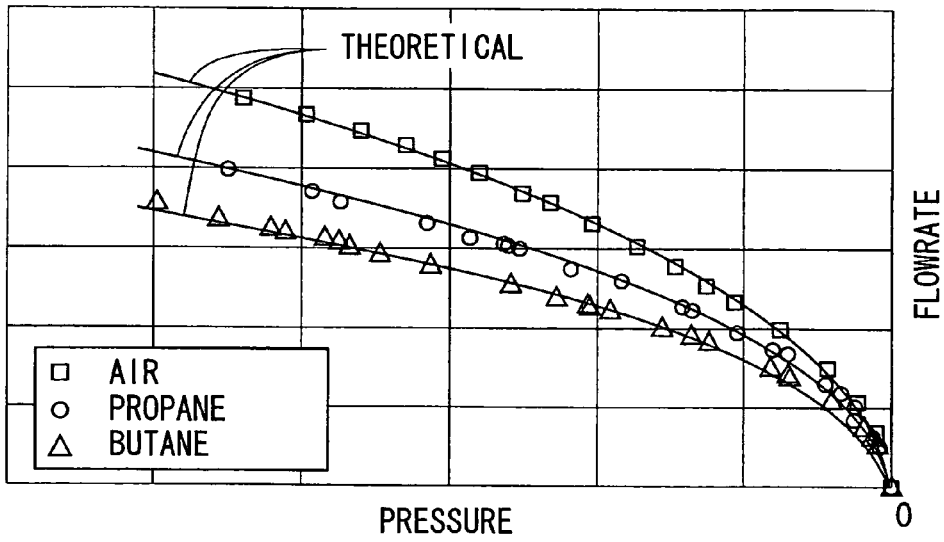
FIG. 6A is a graph showing a characteristics according to the first embodiment.
Figure 6B:
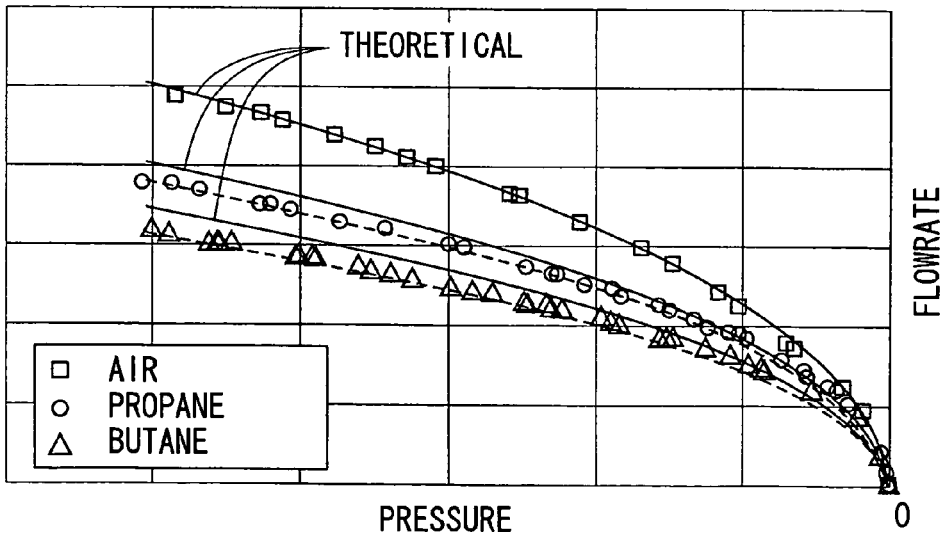
FIG. 6B is a graph showing a characteristics according to a comparative example.

As described above, the coefficients $\alpha_{Gas}$ and $\alpha_{Air}$ depend on the ratio "m" between the flow passage area $A_m$ of the measure-passage 24 and the cross sectional area $A_0$ of the upstream end 14*c* of the orifice 14. That is, the ratio "m" is a constant value ($=1/(1-m^2)^{1/2}$) without respect to kinds and densities of gases. As shown in FIG. 6A, in the present embodiment, the measured values substantially agree with the theoretical characteristic curves with respect to propane and butane. On the other hand, in the comparative example, the measured values deviate from theoretical characteristic curves as shown in FIG. 6B. Thus, the ratio between $\alpha_{Gas}$ and $\alpha_{Air}$ is 1 in the equation (6) so that the ratio between the densities $\rho_{AIR}$ and $\rho_{GAS}$ can be expressed by the following equation (8).

$$\rho_{GAS}/\rho_{AIR}=\{(1-\Delta P_{Air}/P_{tAir})/(1-\Delta P_{Gas}/P_{tGas})\}^2\cdot\Delta P_{Gas}/\Delta P_{Air} \quad (6)$$

Figure 7:
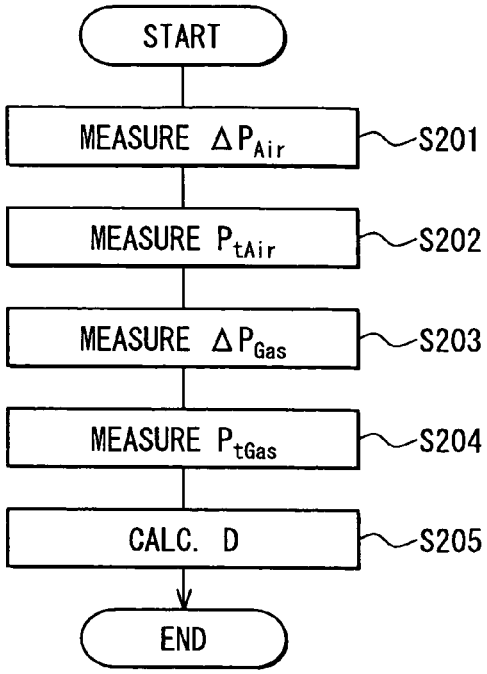
FIG. 7 is a flowchart for explaining a concentration detecting process according to the first embodiment.

Therefore, it is understood that the density ratio between $\rho_{GAS}$ and $\rho_{AIR}$ is calculated based on the equation (6), and then the differential pressures $\Delta P_{Air}$ $\Delta P_{Gas}$ and shutoff pressures $P_{tAir}$ and $P_{tGas}$ are measured in order to calculate the fuel vapor concentration D. Referring to FIG. 7, the concentration detecting process is described hereinafter. Before the concentration detecting process, the pump 12 is OFF, the purge controlling valve 32 is closed, the passage changing valve 33 and the discharge switching valve 35 are in the first condition, and the passage opening/closing valve 34 and the canister close valve 36 are closed.

In step S201, each of the valves 32 to 36 is maintained at a position as well as the position before the concentration detecting process is started, and the pump 12 is started. The measure-passage 24 connected with the first atmosphere passage 23 is decompressed, so that the air flows into the measure-passage 24 from the atmosphere passage 23. The vale measured by the differential pressure sensor 18 varies to a predetermined value, which is stable. The stable measured vale of the differential pressure is stored in a memory of the ECU 38 as the differential pressure $\Delta P_{Air}$ with the air flowing.

In step 202, while the pump 12 is driven, the passage opening/closing valve 34 is closed. Since the measure-passage 24 is closed and the pump 12 is brought into a shutoff condition, the value measured by the differential pressure sensor 18 varies to the stable predetermined value. Here, the stable measured value is stored in the memory of the ECU 38 as the shutoff pressure $P_{tAir}$ of the pump 12.

In step S203, while the pump 12 is driven, the passage changing valve 33 and the discharge switching valve 35 are brought into the second condition, and the passage opening/closing valve 34 are opened. The measure-passage 24 is decompressed, so that air-fuel mixture is flows into the passage 24 from the passages 21 and 22. The value measured by the differential pressure sensor 18 varies to a stable predetermined value. Here, the stable measured value is stored in the memory of the ECU 38 as the differential pressure $\Delta P_{Gas}$ with the air-fuel mixture flowing.

In step S204, while the pump 12 is driven, the passage opening/closing valve 34 is closed. The measure-passage 24 is closed and the pump 12 is brought into a shutoff condition. The differential pressure detected by the sensor 18 varies to the predetermined value which is stable. This measured deferential pressure is stored in a memory of the ECU 38 as the shutoff pressure $P_{tGas}$ of the pump 12.

In step S205, a CPU of the ECU 38 reads the differential pressures $\Delta P_{Air}$ and $\Delta P_{Gas}$, the shutoff pressures $P_{tAir}$ and $P_{tGas}$, and the equations (2) and (8) which have been stored in the memory. The differential pressures $\Delta P_{Air}$ and $\Delta P_{Gas}$, the shutoff pressures $P_{tAir}$ and $P_{tGas}$ are substituted into the equation (8) to obtain the density ratio between pAir and pGas. The density ratio is substituted into the equation (2) to calculate the fuel vapor concentration D. This fuel vapor concentration D is stored in the memory.

Figure 8:
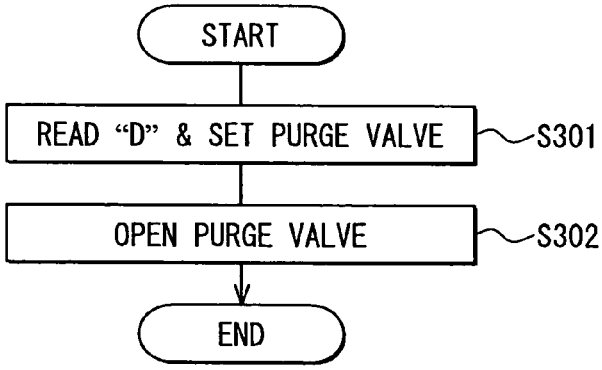
FIG. 8 is a flowchart for explaining a purge process according to the first embodiment.

Referring to FIG. 8, the purge processing in step S104 is described hereinafter. Before the purge processing, the pump 12 is OFF, the purge controlling valve 32 is closed, the passage changing valve 33 and the discharge switching valve 35 are in the first condition, and the passage opening/closing valve 34 and the canister close valve 36 are opened.

In step S301, the CPU of the ECU 38 reads the fuel vapor concentration D stored in step S205. The opening degree of the purge control valve 32 is established according to a physical quantity indicative of vehicle condition, such as accelerator position, and the fuel vapor concentration D.

In step S302, the purge controlling valve 32 is opened in a preset value established in step S301. The negative pressure is introduced into the canister 11, so that the fuel vapor is desorbed from the main adsorption part 44 to be purged into the intake passage 33 according to the opening degree of the purge controlling valve 32. When the purge stop condition is established, the processing of step S302 ends.

In the first embodiment, as described above, since the orifice 14 has the diameter-changing portion 16, the gas does not separate from an inner surface 24*c* of the measure-passage 24 downstream of the orifice 14. Thus, the density ratio between pAir and pGas can be accurately calculated to calculate the fuel vapor concentration D, whereby the accuracy of the purge controlling is also enhanced.

Second Embodiment

Figure 9:
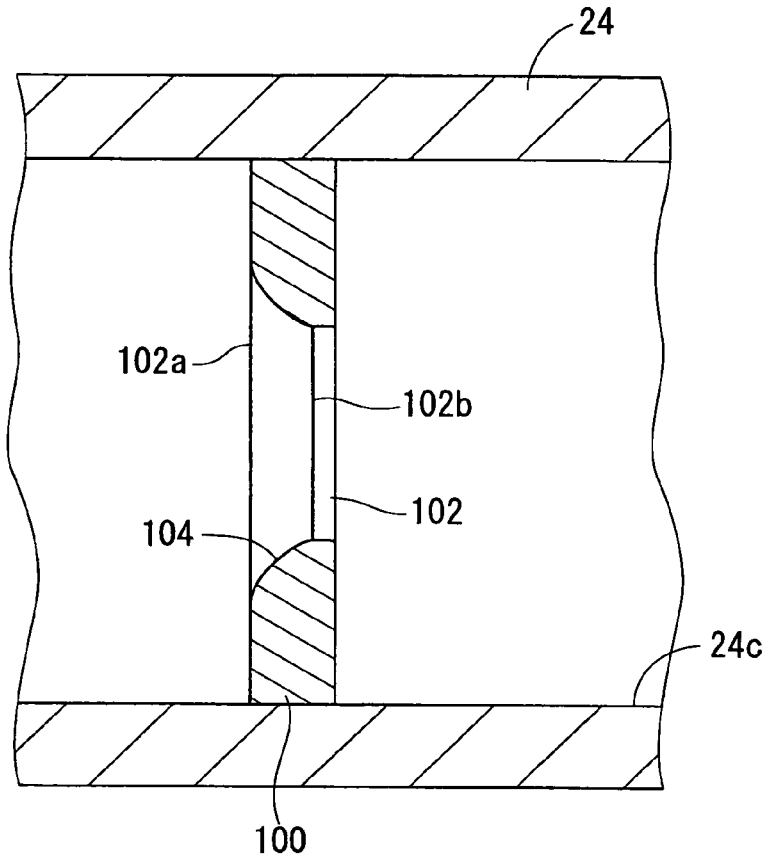
FIG. 9 is a cross sectional view showing an essential portion of a fuel vapor treatment apparatus according to a second embodiment.

Referring to FIG. 9, the second embodiment is described hereinafter. An orifice 100 has a diameter-changing portion 104 between a downstream end 102*a* and a middle portion 102*b*. The inner diameter of the diameter-changing portion 104 decreases in a direction from the downstream end 102*a* to the upstream end, and a shrinking rate of the inner diameter decreases in a direction toward upstream. The inner surface of the diameter-changing portion 104 is rounded in a cross section thereof. The gas hardly separates from the inner surface 24*c* of the measure-passage 24. Thus, the density ratio between pAir and pGas and the fuel vapor concentration D are accurately calculated to perform the purge control accurately.

Figure 10:
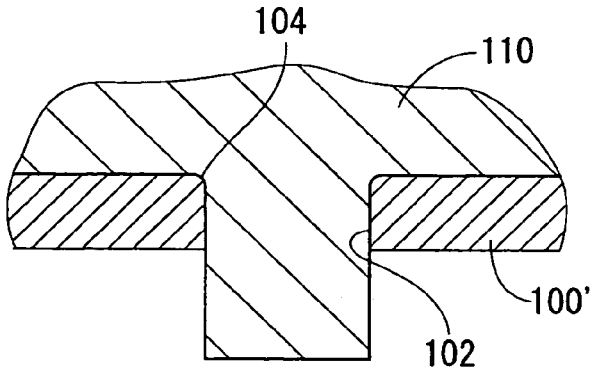
FIG. 10 is a cross sectional view showing a manufacturing method of orifice plate according to the second embodiment.

The diameter-changing portion 104 can be made by punching a plate 100' with a punch 110 as shown in FIG. 10.

Third Embodiment

Figure 11:
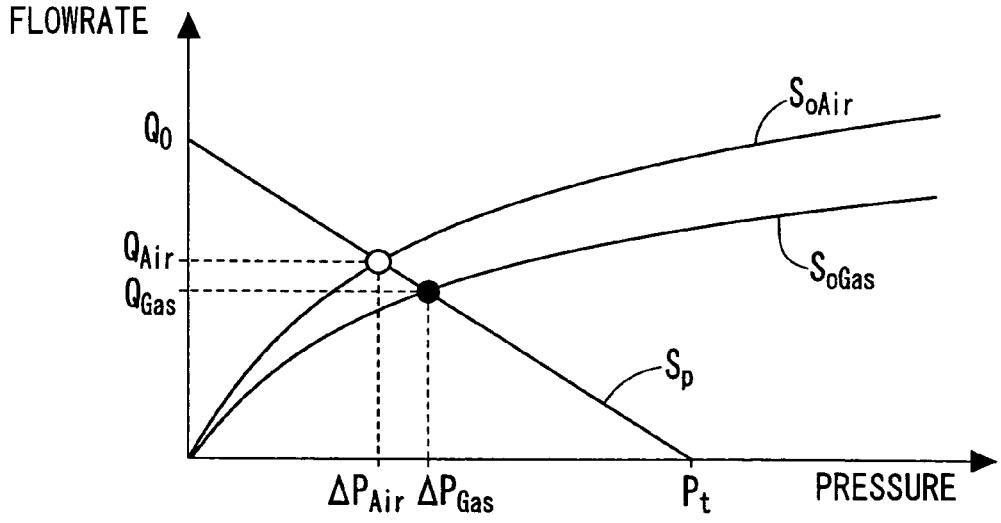
FIG. 11 is a graph for explaining a way of calculating a density ratio according to a third embodiment.

Referring to FIG. 11, a third embodiment is described hereinafter. The way of calculating the density ratio between pAir and pGas in step S102 is different from the first embodiment.

In the case that a diaphragm pump is used as the pump 12, the P-Q characteristic curve $S_p$ is defined without respect to viscosity of the intake air, as shown in FIG. 11. Thus, when the air flows through the orifice 14, the flowrate $Q_{Air}$ and the differential pressure $\Delta P_{Air}$ have a relationship expressed by the following equation (9), and when the air-fuel mixture flows through the orifice, the flowrate $Q_{Gas}$ and the differential pressure $\Delta P_{Gas}$ have a relationship expressed by the following equation (10). In the equations (9) and (10), $P_t$ indicates a shutoff pressure of the pump 12. "K" is expressed by the following equation (11).

$$Q\text{Air}=K\cdot(\Delta P_{Air}-P_t) \quad (9)$$

$$Q\text{Gas}=K\cdot(\Delta P_{Gas}-P_t) \quad (10)$$

$$K=-Q_0/P_t \quad (11)$$

The equation (3) can be transformed into a following equation (12) by use of the equations (9) and (10).

$$\rho_{GAS}/\rho_{AIR}=\{(\alpha_{Gas}/\alpha_{Air})\cdot(\Delta P_{Air}-P_t)/(\Delta P_{Gas}-P_t)\}^2\cdot\Delta P_{Gas}/\Delta P_{Air} \quad (12)$$

In the equation (12), $\alpha_{Gas}$ is equal to $\alpha_{Air}$, the density ratio is finally expressed by the following equation (13).

$$\rho_{GAS}/\rho_{AIR}=\{(\Delta P_{Air}-P_t)/(\Delta P_{Gas}-P_t)\}^2\cdot\Delta P_{Gas}/\Delta P_{Air} \quad (13)$$

It is understood that the fuel vapor concentration D can be calculated based on the equation (2) only by measuring the differential pressures $\Delta P_{Air}$ and $\Delta P_{Gas}$, and the shutoff pressure $P_t$. In the concentration detecting process of the third embodiment, the measured value by the differential pressure sensor 18 is stored as a shutoff pressure $P_t$ in step S202, and the procedure in step 204 is skipped. In step S205, the differential pressures $\Delta P_{Air}$, $\Delta P_{Gas}$ and the shutoff pressure Pt are substituted into the equation (13) to obtain the density ratio between $\rho_{GAS}$ and $\rho_{AIR}$, and then the fuel vapor concentration D is calculated.

In the third embodiment, since the density ratio between $\rho_{GAS}$ and $\rho_{AIR}$ can be calculated based on the equation (13) which does not depend on the flowrate coefficients $\alpha_{Air}$ and $\alpha_{Gas}$, the fuel vapor concentration D can be accurately calculated.

Before shipping the fuel vapor treatment apparatus 10, the shutoff pressure $P_t$ can be measured and be stored in the memory beforehand, and the processing in step S202 can be skipped in the concentration detecting process. In this case, the opening/closing valve 34 is unnecessary.

Fourth Embodiment

Figure 12:
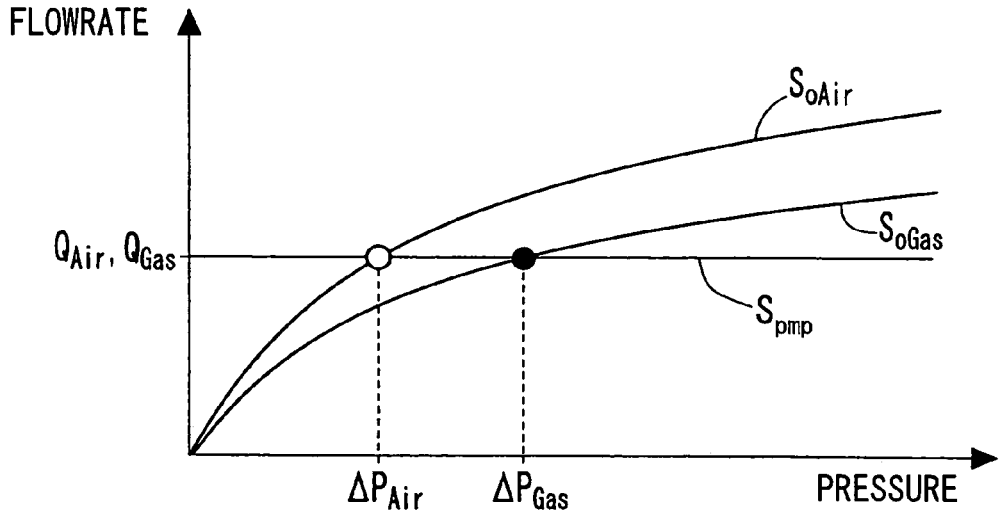
FIG. 12 is a graph for explaining a way of calculating a density ratio according to a fourth embodiment.

Referring to FIG. 12, a fourth embodiment is described hereinafter. The way of calculating the density ratio between $\rho_{Air}$ and $\rho_{Gas}$ in step S102 is different from the first embodiment.

In the case that an ideal positive-displacement pump is used as the pump 12, the flowrate Q is constant as show by the P-Q characteristic line $S_{pmp}$ without respect to kinds of the intake air. Thus, the equation (3) can be transformed into the equation (14). The density ratio can be expressed by the following equation (15).

$$\rho_{GAS}/\rho_{AIR}=(\alpha_{Gas}/\alpha_{Air})^2\cdot\Delta P_{Gas}/\Delta P_{Air} \quad (14)$$

$$\rho_{GAS}/\rho_{AIR}=\Delta P_{Gas}/\Delta P_{Air} \quad (15)$$

It is understood that the fuel vapor concentration D can be calculated based on the equations (2) and (15) only by measuring the differential pressures $\Delta P_{Air}$ and $\Delta P_{Gas}$. In the fourth embodiment, the opening/closing valve 34 is unnecessary and steps S202 and S204 are skipped. In step S205, the differential pressures $\Delta P_{Air}$, $\Delta P_{Gas}$ are substituted into the equation (15) to obtain the density ratio between $\rho_{GAS}$ and $\rho_{AIR}$, and then the fuel vapor concentration D is calculated.

Also in the fourth embodiment, since the density ratio between $\rho_{GAS}$ and $\rho_{AIR}$ can be calculated based on the equation (15) which does not depend on the flowrate coefficients $\alpha_{Air}$ and $\alpha_{Gas}$, the fuel vapor concentration D can be accurately calculated.

Fifth Embodiment

Figure 13:
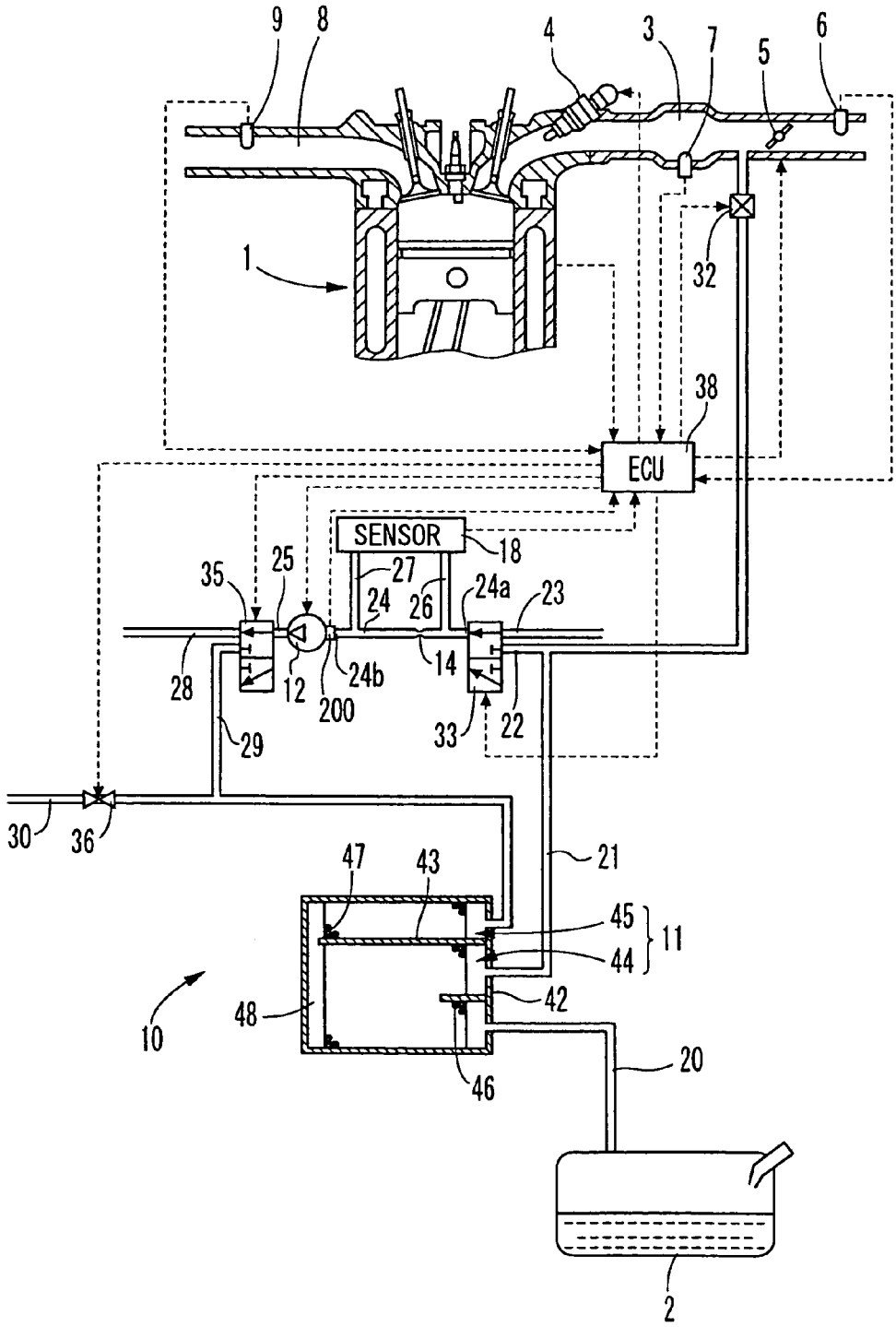
FIG. 13 is a construction diagram showing the fuel vapor treatment apparatus according to a fifth embodiment.
Figure 15:
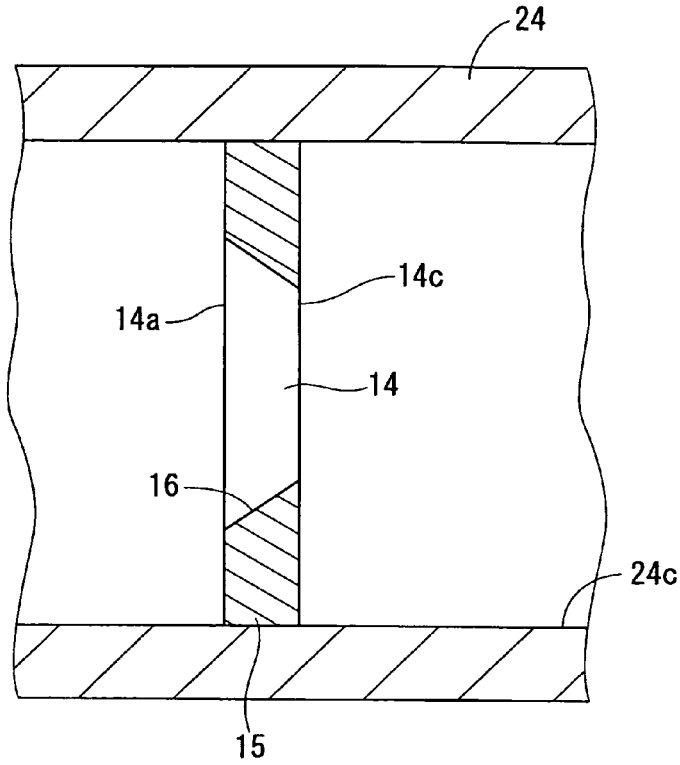
FIG. 15 is a cross sectional view showing an essential portion of a fuel vapor treatment apparatus according to a modification of the present invention.
Figure 16:
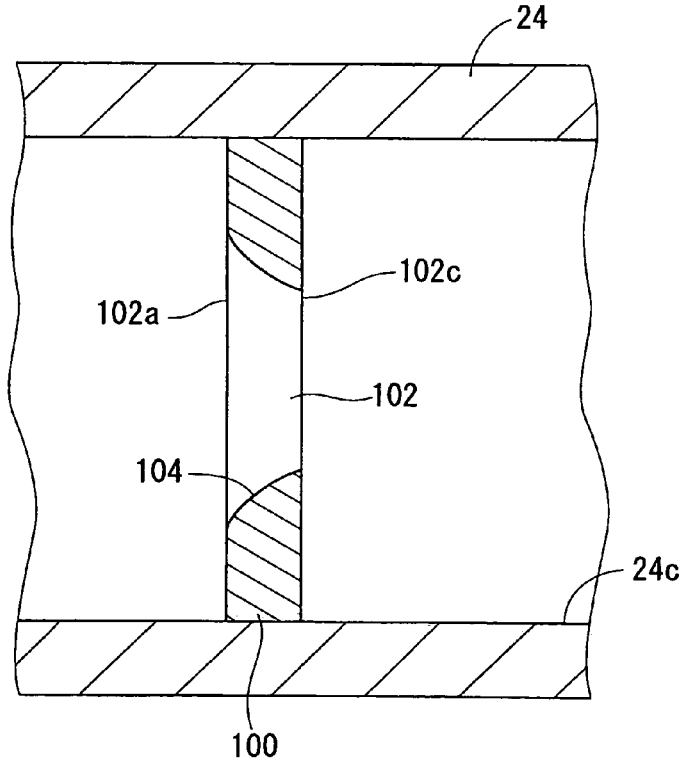
FIG. 16 is a cross sectional view showing an essential portion of a fuel vapor treatment apparatus according to the other modification of the present invention.

Referring to FIG. 13, a fifth embodiment is described hereinafter. In the fifth embodiment, the passage opening/closing valve 34 is not provided, and the pump 12 is provided with a flowrate sensor 200. The flowrate sensor 200 is electrically connected with the ECU 38 in order to measure an intake air flowrate of the pump 12. Since the pressure loss of gas downstream of the orifice 14 in the measure-passage 24 is negligible small, the flowrate measured by the flowrate sensor 200 is substantially consistent with the flowrate of gas passing through the orifice 14.

In the fifth embodiment, the concentration detecting process in step S102 is different from the first embodiment. In the case that the differential pressure $\Delta P_{Air}$ of the air is equal to the differential pressure $\Delta P_{Air}$ of the air-fuel mixture by adjusting the intake air flowrate of the pump 12, the equation (3) can be transformed into the equation (16). The density ratio can be expressed by the following equation (17).

$$\rho_{GAS}/\rho_{AIR}=\{(\alpha_{Gas}/\alpha_{Air})\cdot(Q_{Air}/Q_{Gas})\}^2 \quad (16)$$

$$\rho_{GAS}/\rho_{AIR}=(Q_{Air}/Q_{Gas})^2 \quad (17)$$

Figure 14:
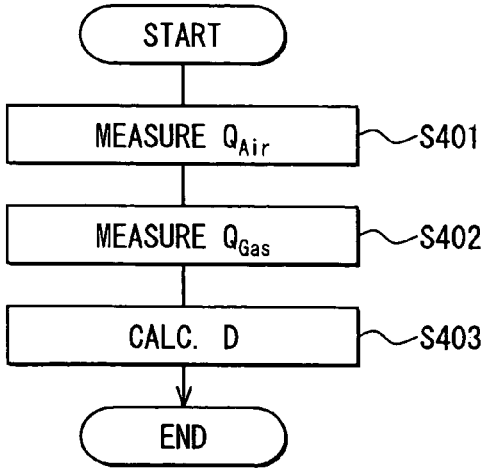
FIG. 14 is a flowchart for explaining a concentration detecting process according to the fifth embodiment.

It is understood that the fuel vapor concentration D can be calculated based on the equations (2) and (17) only by measuring the air flowrate $Q_{Air}$ and $Q_{Gas}$. Referring to FIG. 14, the concentration detecting processing is described hereinafter. Before the concentration detecting processing, the pump 12 is OFF, the passage controlling valve is closed, the passage changing valve 33 and the discharge switching valve 35 are in the first condition, and the canister close valve 36 is opened.

In step S401, the pump 12 is drive in such a manner that the differential pressure detected by the differential pressure sensor 18 becomes the specific value $\Delta P_c$, and the position of each valve 32, 33, 35, 36 is maintained at the position before the concentration detecting processing. The measure-passage 24 is decompressed to introduce the air from the passage 23 into the passage 24. The differential pressure detected by the sensor 18 is maintained as the specific value $\Delta P_c$. The air flowrate measured by the flowrate sensor 200 varies to a predetermined value which is stable. This measured value is stored in the memory of the ECU 38 as the flowrate $Q_{Air}$ of the air passing through the orifice 14.

In step S402, while the pump 12 is driven, the passage switching valve 33 and the discharge switching valve 35 are brought into the second condition. Thereby, the measure-passage 24 is decompressed, so that the air-fuel mixture flows into the passage 24 from the passages 21 and 22, and the differential pressure is maintained at specific value $\Delta P_c$. The flowrate measured by the flowrate sensor 200 is varied to a predetermined value, and then becomes stable. The measured flowrate is stored in the memory of the ECU 38 as the flowrate $Q_{Gas}$ of the air-fuel mixture passing through the orifice 14.

In step S403, the CPU of the ECU 38 reads the flowrate $Q_{Air}$, $Q_{Gas}$ stored in step S401 and step S402 and the equations (17) and (2). In step S403, the flowrate $Q_{Air}$ and $Q_{Gas}$ are substituted into the equation (17) to calculate the density ratio, which is substituted into the equation (2) to calculate the fuel vapor concentration D.

(Modification)

In the first to fifth embodiments, the upstream-pressure-introducing passage 26 can be taken out. The differential pressure sensor 18 can detects a differential pressure between an atmospheric pressure and a pressure in the downstream-pressure-introducing passage 27. In this case, the differential pressure measured by the differential pressure sensor 18 is equal to a differential pressure between both ends of the orifice 14 with the passage opening/closing valve 34 opened.

Absolute pressure sensors can be respectively provided in the introducing passages 26, 27 to detect the differential pressure.

In the first, and the third to fifth embodiments, the diameter-changing portion 16 can be made from the downstream end 14*a* to the upstream end 14*c*. In the second embodiment, the diameter-changing portion 104 can be made from the downstream end 102*a* to the upstream end.

In the above embodiments, the present invention is applied to the fuel vapor treatment apparatus 10 which detects the fuel vapor concentration D. The present invention can be applied to the other apparatus which detects a concentration of specific gases.

What is claimed is:

1. A gas density ratio detecting apparatus comprising:

a measure-passage which plural kinds of gases flow into at separate timings from an upstream end thereof;

a gas flow producing means connected with a downstream end of the measure-passage to decompress the measure-passage;

an orifice provided in the measure-passage to restrict a flow passage area of the measure-passage;

a separation-restricting means for restricting a separation of gases from an inner surface of the measure-passage downstream of the orifice, the separation-restricting means being structured in such a manner that the orifice has a diameter-changing portion having an inner diameter that decreases from a downstream end toward upstream to an intermediate portion and an upstream portion having a constant inner diameter from the intermediate portion to an upstream end;

a measuring means for measuring a pressure determined by the orifice and the gas flow producing means or for measuring a flowrate of gas flowing through the orifice with the measure-passage decompressed; and a density ratio calculating means for calculating a density ratio between gases based on the pressure or the flowrate of gas measured by the measuring means with respect to plural kinds of gases.

2. A gas density ratio detecting apparatus according to claim 1, wherein a shrinking rate of the inner diameter of the orifice by means of the separation-restricting means is a constant value.

3. A gas density ratio detecting apparatus according to claim 1, wherein a shrinking rate of the inner diameter of the orifice by means of the separation-restricting means decrease toward the upstream end of the orifice.

4. A gas concentration detecting apparatus comprising:

a measure-passage which plural kinds of gases flow into at separate timings from an upstream end thereof;

a gas flow producing means connected with a downstream end of the measure-passage to decompress the measure-passage;

an orifice provided in the measure-passage to restrict a flow passage area of the measure-passage;

a separation-restricting means for restricting a separation of gases from an inner surface of the measure-passage downstream of the orifice, the separation-restricting means being structured in such a manner that the orifice has a diameter-changing portion having an inner diameter that decreases from a downstream end toward upstream to an intermediate portion and an upstream portion having a constant inner diameter from the intermediate portion to an upstream end;

a measuring means for measuring a pressure determined by the orifice and the gas flow producing means or for measuring a flowrate of gas flowing through the orifice with the measure-passage decompressed; and a density ratio calculating means for calculating a density ratio between gases based on the pressure or the flowrate of gas measured by the measuring means with respect to plural kinds of gases; and a gas concentration calculating means for calculating a concentration of the specific gas based on the detected gas density ratio.

5. A fuel vapor treatment apparatus comprising:

a canister which adsorbs and desorbs a fuel vapor evaporated in a fuel tank;

a purge passage for purging a fuel vapor into an intake passage of an engine, the fuel vapor being desorbed from the canister;

a measure-passage which plural kinds of gases flow into at separate timings from an upstream end thereof;

a gas flow producing means connected with a downstream end of the measure-passage to decompress the measure-passage;

an orifice provided in the measure-passage to restrict a flow passage are of the measure-passage;

a separation-restricting means for restricting a separation of gases from an inner surface of the measure-passage downstream of the orifice, the separation-restricting means being structured in such a manner that the orifice has a diameter-changing portion having an inner diameter that decreases from a downstream end toward upstream to an intermediate portion and an upstream portion having a constant inner diameter from the intermediate portion to an upstream end;

a measuring means for measuring a pressure determined by the orifice and the gas flow producing means or for measuring a flowrate of gas flowing through the orifice with the measure-passage decompressed;

a density ratio calculating means for calculating a density ratio between gases based on the pressure or the flowrate of gas measured by the measuring means with respect to plural kinds of gases, a gas concentration calculating means for calculating a concentration of the specific gas based on the detected gas density ratio; and a purge controlling means for controlling a purge amount of fuel vapor based on the gas concentration of the fuel vapor.

* * * * *

UNITED STATES PATENT AND TRADEMARK OFFICE

CERTIFICATE OF CORRECTION

PATENT NO. : 7,234,450 B2
APPLICATION NO. : 11/397891
DATED : June 26, 2007
INVENTOR(S) : Takakura et al.

It is certified that error appears in the above-identified patent and that said Letters Patent is hereby corrected as shown below:

On the Title Page, item:

"(73) Assignees: Denso Corporation (JP);
Toyota Jidosha Kabushiki Kaisha (JP)"

should be

--(73) Assignees: Denso Corporation (JP);
Nippon Soken, Inc. (JP)
Toyota Jidosha Kabushiki Kaisha (JP)--.

Signed and Sealed this

Third Day of November, 2009

David J. Kappos

David J. Kappos
*Director of the United States Patent and Trademark Office*